United States Patent [19]

Minami

[11] Patent Number: 4,607,937

[45] Date of Patent: Aug. 26, 1986

[54] ELECTROSTATIC RECORDING APPARATUS

[75] Inventor: Koji Minami, Osaka, Japan

[73] Assignee: Sanyo Electric Co., Ltd., Japan

[21] Appl. No.: 672,374

[22] Filed: Nov. 16, 1984

[51] Int. Cl.[4] ..... G03G 15/00

[52] U.S. Cl. ..... 355/3 R; 355/3 DR; 355/14 R; 355/3 CH; 355/14 CH; 361/225

[58] Field of Search ..... 355/3 R, 3 DR, 14 R, 355/3 CH, 14 CH; 361/225, 235

[56] References Cited

U.S. PATENT DOCUMENTS

| | | | |
|---|---|---|---|
| 4,148,577 | 4/1979 | Nishikawa et al. | 355/14 R X |
| 4,165,169 | 8/1979 | Miyashita et al. | 355/3 DR |
| 4,348,098 | 9/1982 | Koizumi | 355/14 CH X |
| 4,371,252 | 2/1983 | Uchida et al. | 361/225 |
| 4,484,809 | 11/1984 | Coleman | 355/3 BE X |
| 4,484,812 | 11/1984 | Takayanagi | 355/14 CH |

*Primary Examiner*—A. C. Prescott

*Attorney, Agent, or Firm*—Darby & Darby

[57] ABSTRACT

An electrostatic recording apparatus comprises a photosensitive drum, and this photosensitive drum includes a substrate composed of a conductive material and a photoconductive layer composed of amorphous silicon which is formed thereon. A resistor is connected between the conductive substrate and a reference potential. When a current flows through the photoconductive layer of the photosensitive drum, a bias voltage is produced by this resistor. The surface potential of the photoconductive layer is kept constant by the voltage of the photoconductive layer and the bias voltage, and accordingly, the voltage to be kept by the photoconductive layer itself can be small, and the amount of the current flowing into the photoconductive layer can be small. Preferably, a capacitor is connected in parallel with the resistor. This capacitor prevents the surface potential of the photoconductive layer from being affected by AC discharging of a separating corotron.

8 Claims, 15 Drawing Figures

ELECTROSTATIC RECORDING APPARATUS

BACKGROUND OF THE INVENTION

1. Field of the Invention

The present invention relates to an electrostatic recording apparatus. More specifically, the present invention relates to an electrostatic recording apparatus wherein a photoconductive layer such as of amorphous silicon is exposed and an electrostatic latent image is formed thereon and then this electrostatic latent image is developed by a toner.

2. Description of the Prior Art

Electrostatic recording apparatus, as is well known, include a photosensitive drum and this photosensitive drum includes a photoconductive layer supported by a conductive substrate. And, charges of positive polarity are accumulated on the photoconductive layer by a charging corotron, and thereafter an electrostatic latent image is formed on the photoconductive layer by exposing the same. The electrostatic latent image is developed by using a toner.

For the photoconductive layer of such an electrostatic recording apparatus, conventionally, selenium has been frequently employed. When the photoconductive layer is of selenium, the surface potential charged by the charging corotron is 600–800 V, and to obtain such a surface potential, a current of only about 20 $\mu$A is drawn into a photosensitive drum, that is, photoconductive layer from the charging corotron.

On the other hand, recently, for such a photoconductive layer of the photosensitive drum, using amorphous silicon excelling in the mechanical strength, such as wear resisting property and the like has been proposed and realized. For example, refer to the Japanese Patent Application Laid-Open No. 130038/1982 laid open on Aug. 12, 1982.

In the case where the photoconductive layer is amorphous silicon, the specific resistance thereof is smaller in comparison with that of the conventional selenium or the like, and therefore high voltage can not be kept at the photoconductive layer, and the surface potential thereof is, for instance, about 400 V. Then, in order to charge the photoconductive layer of amorphous silicon up to 400 V, usually a current of about 200–250 $\mu$A is drawn into the photosensitive drum from the charging corotron.

However, when such a large current flows into the photoconductive layer, non-uniformity of charging due to non-uniform discharging of the charging corotron takes place on the photoconductive layer. Such a non-uniform charging incurs a partial breakdown in the photoconductive layer. Then, the breakdown as described above remains a permanent damage, and resultingly, no electrostatic latent image is formed at that portion, and accordingly a so-called "white blank" takes place.

Thus, in the case where the photoconductive layer whose main body is amorphous silicon is employed for the photosensitive body, a large current is required to keep the surface potential thereof at a certain value or more, while, if such a large current flows, the electric strength of the photoconductive layer is deteriorated, resulting in a short life of the photosensitive body.

SUMMARY OF THE INVENTION

Therefore, the principal object of the present invention is to provide an electrostatic recording apparatus capable of elongating the life of photosensitive body by suppressing a deterioration of electric characteristics thereof.

The present invention is an electrostatic recording apparatus wherein the photoconductive layer of the photosensitive body is connected to a reference potential, for example, the ground potential by a resistance means to achieve the above-described object.

In accordance with the present invention, the surface potential of the photosensitive body is divided into the photosensitive body itself and the resistance means which is connected between the photosensitive body and the reference potential, and the resistance means performs the function as a bias, and thereby the surface potential itself of the photoconductive layer can be kept at a sufficiently large value. Accordingly, the voltage to be kept by the photoconductive layer itself can be made smaller in comparison with that of the conventional case, and accordingly, even if the photoconductive layer of the photosensitive body is composed of a material of small specific resistance such as amorphous silicon, a large current as in the conventional case is not required to flow into the photoconductive layer, and the amount of the current flowing into the photoconductive layer, that is, the photosensitive body can be small. Accordingly, in accordance with the present invention, non-uniformity of charging on the photoconductive layer can be eliminated, and deterioration of the electric strength of the photoconductive layer is reduced, and thereby a longer life of electrostatic recording apparatus is obtainable.

In a preferable embodiment in accordance with the present invention, a reactance means for forming a time-constant circuit in cooperation with the resistance means is employed. For such a reactance means, for example, a capacitor is used. The time-constant circuit is used advantageously in the case where a separating corotron of AC discharging type is employed, for instance, in the electronic copier. That is, when the separating corotron of AC discharging type is used, the surface potential of the photoconductive layer becomes non-uniform because the photosensitive body is affected by AC discharging of the separating corotron, but a flow-in of the AC component attending on such as AC discharging can be prevented by the time-constant circuit, and thereby the surface potential of the photoconductive layer becomes even more uniform.

These objects and other objects, features, aspects and advantages of the present invention will become more apparent from the following detailed description of the embodiments of the present invention when taken in conjunction with accompanying drawings.

BRIEF DESCRIPTION OF THE DRAWINGS

FIG. 5 is a circuit diagram showing a measuring apparatus for measuring the surface potential, the drum current and the like.

DESCRIPTION OF THE PREFERRED EMBODIMENTS

Figure 1:
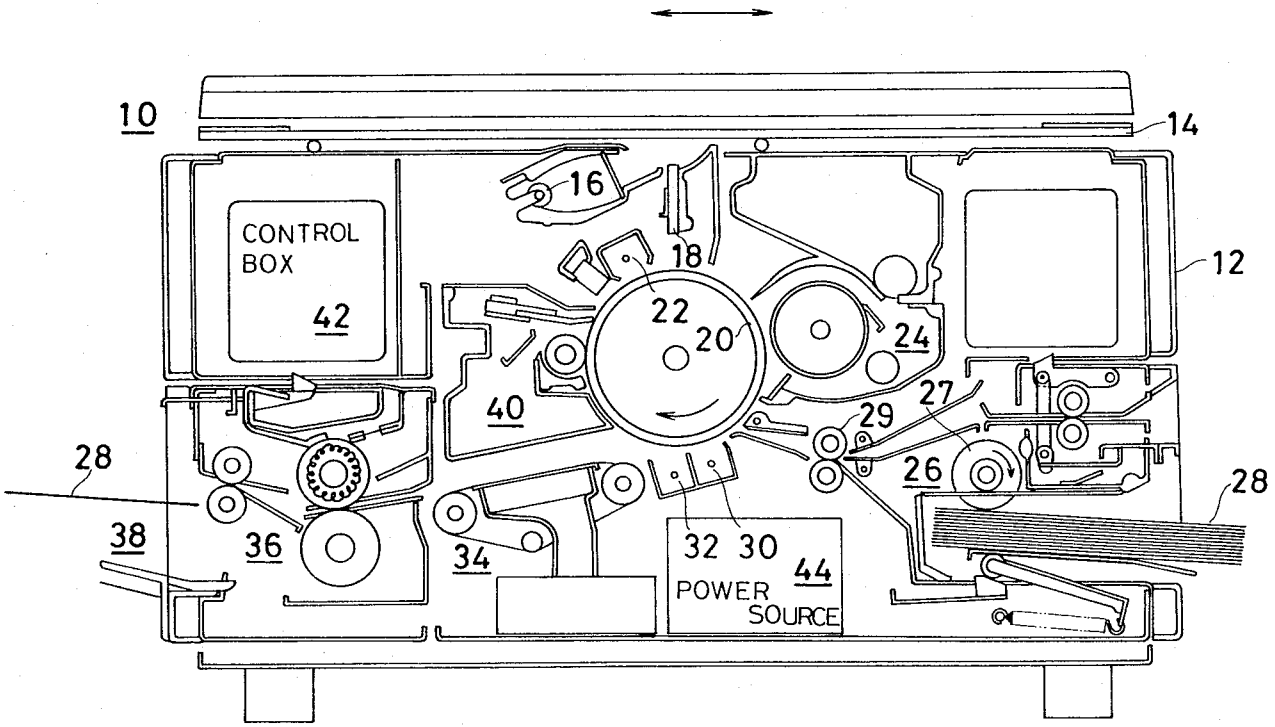
FIG. 1 is an illustrative structure view showing an electronic copier whereto the present invention is applicable.

FIG. 1 is an illustrative structure view showing an electronic copier as one example of an electrostatic recording apparatus whereto the present invention is applicable. It is pointed out in advance that in addition to such an electronic copier, the present invention is applicable to all electrostatic recording apparatus such as; for example, printers, facsimiles and others wherein the photosensitive body is charged and thereafter exposed, and then an electrostatic latent image is formed on that photosensitive body.

First, schematic description is made on this electronic copier to the extent required for understanding this invention. An electronic copier 10 includes a body 12, and on the top of this body 12 an original copy table 14 for placing an original copy (not illustrated) thereon is provided movably or slidably in the direction shown by an arrow mark. A slit is formed on the top surface of the body 12, and a light source 16, for example, a halogen lamp is installed in a fixed fashion in the body 12 associated with the slit. Associated with this light source 16, a reflecting mirror whose section is elliptic is installed, and the light from the light source 16 is reflected by this reflecting mirror, being irradiated on the original copy placed on the original copy table 14. Accordingly, in response to the movement of the original copy table 14 in the direction shown by the arrow mark, the original copy receives the light from the light source 16 through the above-mentioned slit and reflects it. The light reflected from the original copy, that is, an original copy image is projected on a photosensitive drum 20 through a short focal distance lens array 18 installed in a fixed fashion under the slit to produce an image. This short focal distance lens array 18 is composed of a convergent photoconductor wherein a large number of rod lenses are closely arranged. Furthermore, it is needless to say that such a short focal distance lens array 18 may be replaced with another plastic lens or normal convex lens.

Figure 3:
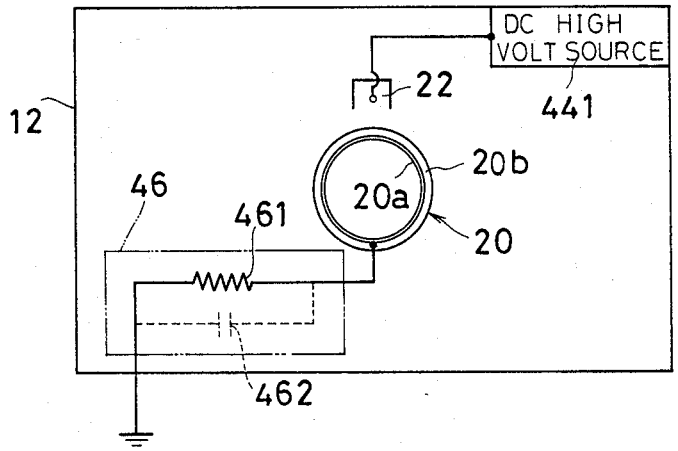
FIG. 3 is an electric circuit diagram showing one embodiment in accordance with the present invention.

The photosensitive drum 20 is disposed at nearly the center in the body 12 of this electronic copier 10, and is rotated clockwise by a driving source (not illustrated) in synchronization with the movement of the original copy table 14. The photosensitive drum 20, as shown in FIG. 3, includes a conductive substrate **20*a* and a photoconductive layer 20*b* composed of amorphous silicon which is formed thereon in a laminated fashion. Furthermore, at the surroundings of the photosensitive drum 20, a charging corotron 22, a developing apparatus 24, a paper feeder 26, a transferring corotron 30, a separating corotron 32 and a cleaning apparatus 40** are arranged in the sequence of rotary direction thereof.

The charging corotron 22 is for uniformly accumulating charges of a certain polarity, for example, of positive polarity on the photoconductive layer **20*b* of this photosensitive drum 20 (FIG. 3) before an original copy image is focused on the photosensitive drum 20, being connected to a DC high voltage power source not illustrated here. When the original copy image is irradiated on the photosensitive drum 20 which has been charged by this charging corotron 22 through the short focal distance lens array 18, an electrostatic latent image is formed on the photosensitive drum 20 as a function of photoconductive characteristics of the photoconductive layer 20*b***.

The developing apparatus 24 is for developing the electrostatic latent image formed on such a photosensitive drum 20 into a visible image by a toner charged in a certain polarity, for example, negative polarity, and includes, as is well known, a toner box, a magnetic brush and the like.

The paper feeder 26 is for feeding a paper 28 laminated in a paper feeding cassette (not illustrated) one by one to the surface of the photosensitive drum 20. For this purpose, the paper feeder 26 includes a paper feeding roller 27 and a register roller 29. The paper feeding roller 27 is rotated clockwise by a prime mover which is not illustrated, and takes-in the paper 28 in contact with the peripheral face thereof in the direction of the register roller 29. The register roller 29 is for sending the paper fed by the paper feeding roller 27 in the direction of the photosensitive drum 20 at an appropriate timing.

Thus the paper fed from the paper feeder 26 is brought to the position of the transferring corotron 30 in the state of contact with the surface of the photosensitive drum 20 in response to the rotation of the photosensitive drum 20. This transferring corotron 30 generated charges of reverse polarity to that of the toner of the developing apparatus 24. Accordingly, the toner forming a toner image on the photosensitive drum 20 is attracted by an electric field of the transferring corotron 30, being transferred onto the paper 28.

The separating corotron 32 is for separating the paper which is going to adhere closely to the photosensitive drum 20 from the photosensitive drum 20 in the above-mentioned transferring, being composed, for example, of an AC corona discharger. The paper separated by the separating corotron 32 is further carried by a carrying conveyor 34 installed at the downstream side of the carrying direction.

This carrying conveyor 34 includes a mesh-shaped endless belt which is driven by a driving source (not illustrated) and a vacuum unit installed under the endless belt. Accordingly, the paper is brought on the mesh belt and sucked by the vacuum unit, and then carried in the direction of a fixing apparatus 36 attending on the movement of the belt.

Above the carrying conveyor 34, the cleaning apparatus 40 is installed associated with the photosensitive drum 20. This cleaning apparatus 40 is for removing the toner remaining on the photosensitive drum 20 after the toner image on the photosensitive drum 20 is transferred onto the paper. For this purpose, this cleaning apparatus 40 includes a blade for scraping the remaining toner by contacting with the surface of the photosensitive drum 20, a box for accommodating the toner thus scraped off, and the like.

The fixing apparatus 36 includes a heating roller having an electric heater and a pressing roller for pressing the paper whereon the toner image is transferred previously. Accordingly, when the paper passes between these two roller, the toner on the paper is melted by the heating roller, and is simultaneously pushed into the inner part of the paper texture by the pressing roller, and thereby the toner image is fixed on the paper. Thereafter, the paper 28 is discharged on a discharged paper tray 38 by a paper discharging roller.

In the body 12, a control box 42 is installed, and in this control box 42, a printed circuit board (not illustrated) forming an electric circuit for controlling an overall operation of the system as described above and the like are accommodated.

Furthermore, in the lower part of the body 12, a power source unit 44 is accommodated. This power source unit 44 includes driving power sources for supplying respective driving source such as motor (not illustrated) with electric power, a DC high voltage power source for applying a DC high voltage to the charging corotron 22 and the transferring corotron 30 and an AC high voltage power source for applying an AC high voltage to the separating corotron 32.

Figure 2:
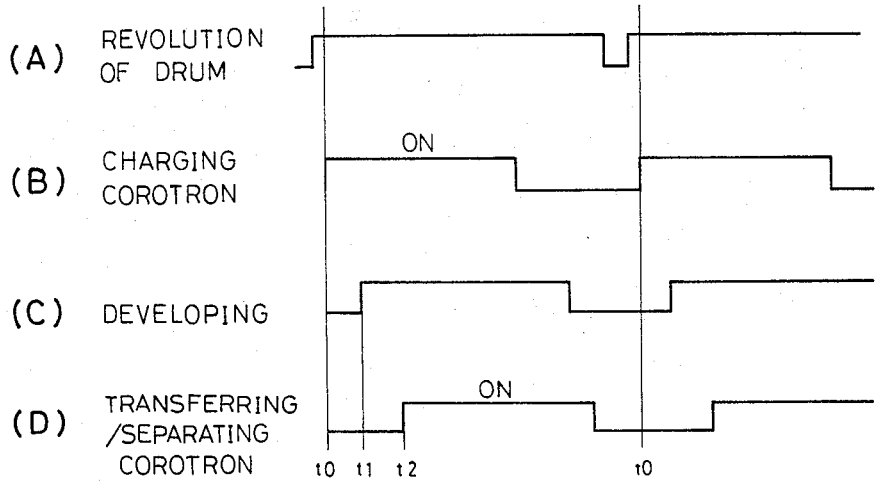
FIG. 2 is a timing chart for schematically explaining operation of an electronic copier as shown in FIG. 1.

In the electronic copier 10 as shown in FIG. 1, when the original copy is placed on the original copy table 14 and a start button (not illustrated) is pushed, the original copy table 14 moves in the direction as shown by the arrow mark, and the optical image formed by the light source 16 is irradiated on the photosensitive drum 20 through the short focal distance lens array 18. Prior to this step, the photosensitive drum 20 is started to rotate by a driving source (not illustrated) as shown in FIG. 2(A). After the photosensitive drum 20 starts to rotate, as shown in FIG. 2(B), discharging by the charging corotron 22 is started at a timing t0. Consequently, before the pertinent portion of the photosensitive drum 20 reaches beneath the short focal distance lens array 18, a predetermined amount of charges are accumulated on that portion by the charging corotron 22. Thereafter, the above-mentioned exposure is performed and an electrostatic latent image is formed on the exposed portion of the photoconductive layer 20*b*. Next, as shown in FIG. 2(C), developing is started at a timing t1, and subsequently, as shown in FIG. 2(D), at a timing t2 the transferring corotron 30 and the separating corotron 32 start to operate.

FIG. 3 is a circuit diagram showing one embodiment in accordance with the present invention. As shown in FIG. 3, the photosensitive drum 20 includes the cylindrical substrate 20*a* composed of, for example, aluminum or a similar metal material and the photoconductive layer 20*b* formed on this substrate 20*a*, and this photoconductive layer 20*b* is formed of, for one example, amorphous silicon. For such an amorphous silicon, for instance, the one which is disclosed in the Japanese Patent Application Laid-Open No. 130038/1982 cited previously can be utilized. Then, at the periphery of the photosensitive drum 20, as is described above, the charging corotron 22 is provided, and this corotron 22 is connected to a DC high voltage power source 441 included in the power source unit 44 (FIG. 1).

On the other hand, the substrate 20*a* of the photosensitive drum 20 is connected to the reference potential, that is, the ground potential through a resistance circuit 46. The resistance circuit 46 includes a resistor 461, and preferably includes a capacitor 462 connected in parallel with this resistor 461. In the case where the resistor 461 and the capacitor 462 are used, this resistance circuit 46 is formed as a charging/discharging circuit, that is, a time-constant circuit.

Figure 4A:
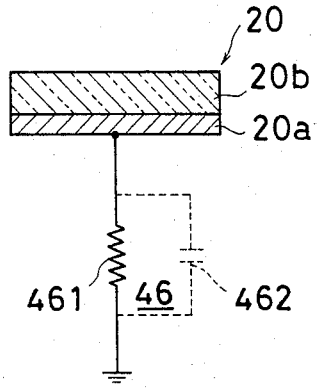
FIG. 4 is an equivalent circuit diagram of the FIG. 3 embodiment.

This FIG. 3 embodiment can be represented by an equivalent circuit as shown in FIG. 4. That is, the photoconductive layer 20*b* of the photosensitive drum 20 can be considered as a parallel circuit composed of a resistor and a capacitor, and the respective values of the resistor and the capacitor are varied depending upon the above-mentioned exposure.

The present invention intends to reduce a current Id flowing in the photosensitive drum 20 by using such a resistance circuit 46, and also to keep the surface potential Vs of the photoconductive layer 20*b* of the photosensitive drum 20 at a constant value, for example, at 400 V. That is, the voltage developed across the both ends of the resistor 461 included in the resistance circuit 46 is utilized as a bias voltage Vbias for raising the surface potential Vs, and therefore the drum current Id can be small.

Basically, a bias effect by the resistance circuit 46 is enabled only during the period wherein a current flows in the resistance circuit 46, and since a photocurrent flowing in the photoconductive layer at exposure is small and nearly negligible, the current flows during the periods shown by "ON" in FIG. 2(B) and FIG. 2(D). Furthermore, the surface potential of the photosensitive drum 20 is required to be larger to some extent than the developing bias in the developing period as shown in FIG. 2(C).

Figure 5:
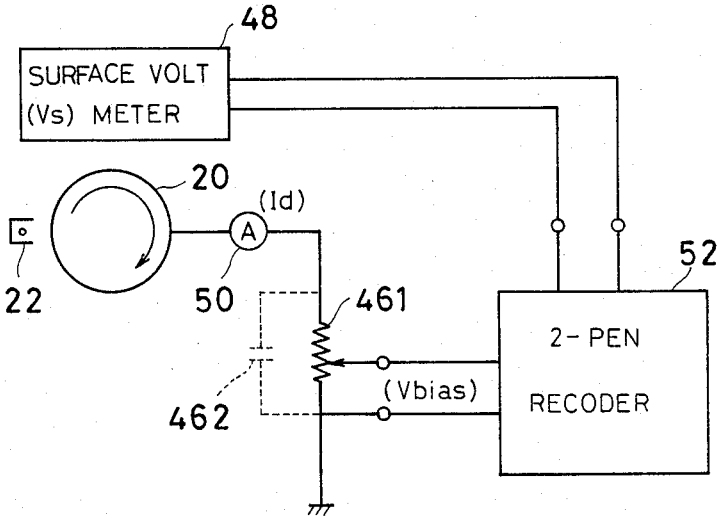

Then, in order to make sure of the effect of the resistance circuit 46, the inventor conducted experiments by variously varying the value of each element in the resistance circuit 46. In the experiments, the drum current Id flowing into the photosensitive drum 20, the surface potential Vs of the photoconductive layer 20*b* and the bias voltage Vbias produced by the resistance circuit 46 were measured using a measuring circuit as shown in FIG. 5.

More specifically, a surface potential meter 48 is installed in the vicinity of the photosensitive drum 20, and a DC ampere meter 50 is connected between the photosensitive drum 20 and the resistance circuit 46. Then, the bias voltage (or a voltage proportional thereto) is picked up from an appropriate place of the resistor 461 included in the resistance circuit 46. The surface voltage Vs measured by the surface potential meter 48 and the bias voltage Vbias produced by the resistance circuit 46 are both given to a two-pen recording apparatus 52. Respective waveforms of the surface potential Vs and the bias voltage Vbias are recorded on a predetermined recording paper with respective pens in the two-pen recording apparatus 52.

Next, description is made on the results of the experiments in reference to FIG. 6 through FIG. 15.

Figure 6:
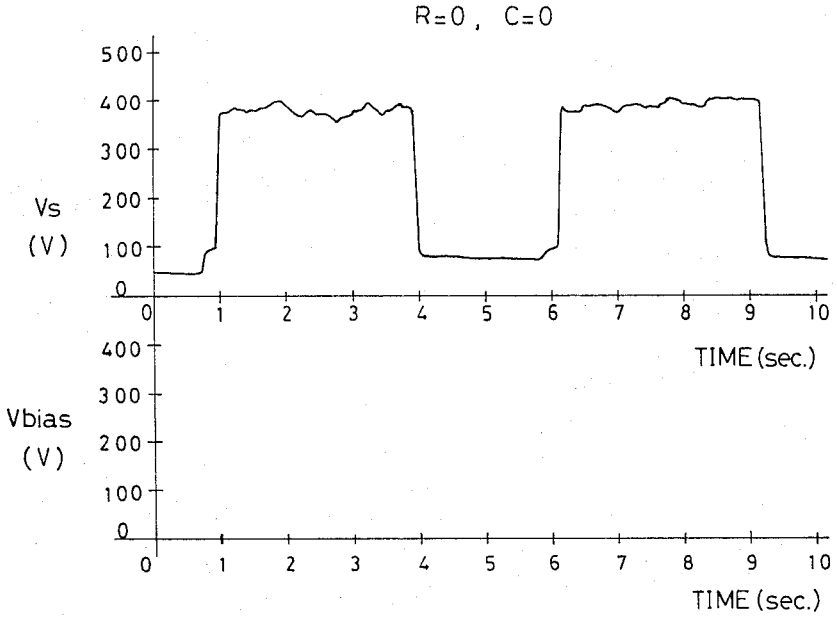
FIG. 6 is a graph showing a waveform of the surface potential of the photoconductive layer in the prior art.

FIG. 6 is a waveform graph showing the surface potential Vs and the bias voltage Vbias in the case where the resistance circuit 46 (FIG. 3) is absent, that is, in the prior art.

Figure 4B:
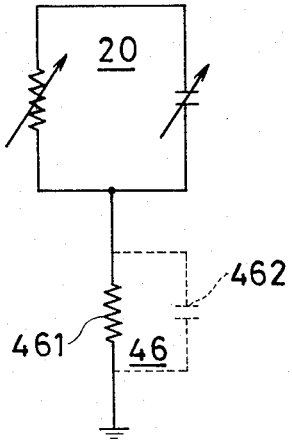
Figure 7:
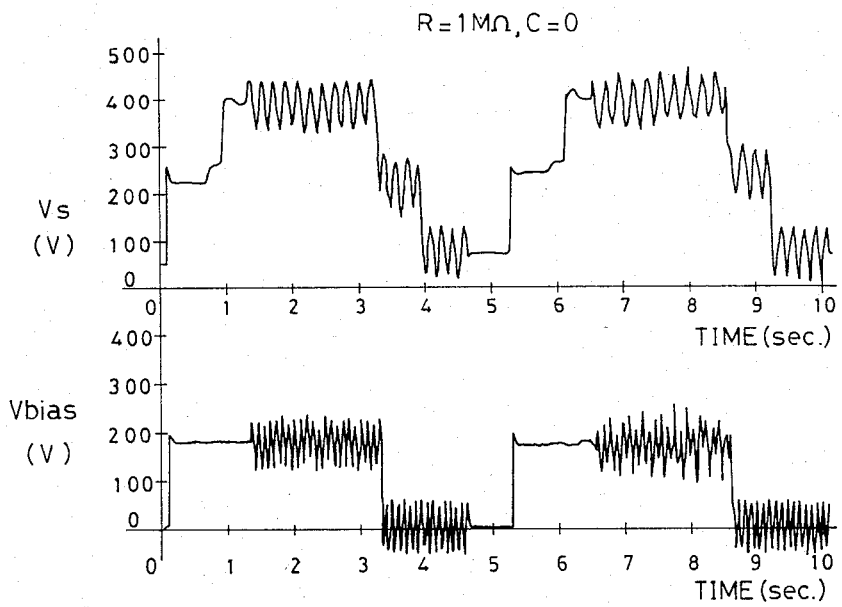
FIG. 7 through FIG. 15 are graphs respectively showing waveforms of the surface potential and the bias voltage of the photoconductive layer in different embodiments in accordance with the present invention.

First, the resistance circuit 46 (FIG. 3) including only the resistor 461 whose resistance value is 1M * was connected. In this case, the surface potential Vs and the bias voltage Vbias become as shown in FIG. 7, respectively. As is apparent from this FIG. 7, when the resistance circuit 46 is connected between the photosensitive drum 20, that is, the photoconductive layer 20*b* and the ground potential, the bias voltage Vbias as shown at the lower part of FIG. 7 is developed across the both ends of the resistor 461 when a current flows through the photosensitive body 20. The surface potential Vs of the photoconductive layer 20*b* is set to about 400 V like the conventional example as shown in FIG. 6. This surface potential Vs, as is apparent from the equivalent circuit in FIG. 4(B), is a sum of the voltage of the photosensitive drum 20 and the above-mentioned bias voltage Vbias. In the case of FIG. 7, the bias voltage is about 200 V, and accordingly, the photosensitive drum 20 itself has only to share a voltage of about 200 V. Thus, the voltage to be shared by the photosensitive drum 20 can be reduced to 200 V from 400 V in the conventional case, and therefore not only the share of the photosensitive drum 20 is reduced, but also the drum current Id flowing through the ampere meter 50 (FIG. 5) becomes smaller than that in the conventional case. More specifically, the current Id was about 235 μA in the conventional case as shown in FIG. 6, but was about 173*A in the case as shown in FIG. 7.

In an example as shown in FIG. 7, the bias voltage Vbias and therefore the surface potential Vs are affected by the separating corotron 32 (FIG. 1) due to an action of the resistor 461 of the resistance circuit 46. This is because the substrate 20*a* of the photosensitive drum 20 is connected to the ground through the resistor 461 of 1 MΩ. In order to remove such an effect of AC high voltage, the capacitor 462 has only to be connected in parallel with the resistor 461 in the resistance circuit 46.

Figure 8:
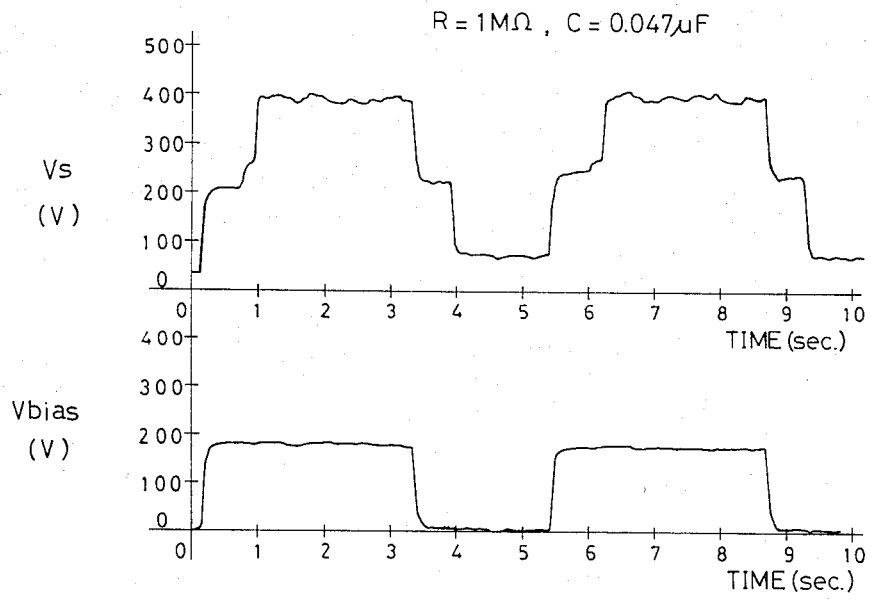

FIG. 8 is a graph showing waveforms of the bias voltage and the surface potential in the case where the resistor 461 of 1 MΩ and the capacitor 462 of 0.047 μF connected in parallel thereto are used as the resistance circuit 46. As is obvious from this FIG. 8, the effect of AC high voltage as shown in FIG. 7 can be removed only by connecting the capacitor of very small capacitance, for example, 0.047 μF in parallel with the resistor 461. In an example as shown in this FIG. 8, although the drum current Id is affected by the reactance of the capacitor 462, since the capacitance of the capacitor 462 is very small, the current Id was about 173 μA likewise the case of FIG. 7.

Figure 9:
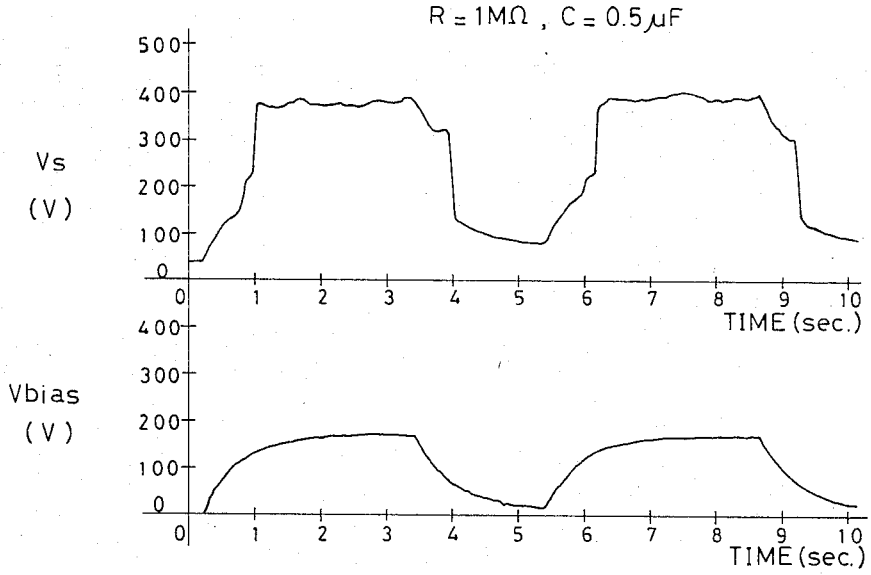

FIG. 9 is a waveform graph in the case where the resistor 461 of 1 MΩ and the capacitor 462 of 0.5 μF are used as the resistance circuit 46. In this case, a time-constant circuit having a certain magnitude of time-constant is constituted with the resistor 461 and the capacitor 462, and in response to the time-constant, the bias voltage Vbias increases exponentially, reaching about 200 V. The surface potential Vs is kept at a required value, for example, 400 V. Consequently, the voltage to be kept at the photosensitive drum 20 (photoconduction layer 20*b*) can be about 200 V. On the other hand, due to the reactance of the capacitor 462, the drum current Id increases a little, becoming about 175 μA.

Figure 10:
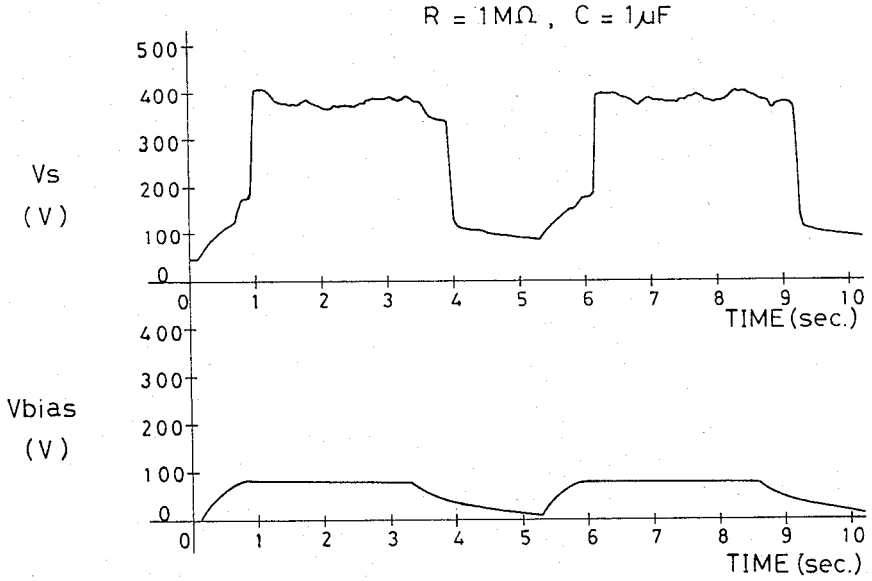

FIG. 10 is a waveform graph in the case where the resistor 461 of 1 MΩ and the capacitor 462 of 1 μF are connected as the resistance circuit 46.

In this example of FIG. 10, the time-constant determined by the resistor 461 and the capacitor 462 becomes large, and the bias voltage Vbias produced by the resistor circuit 46 becomes a small value of about 100 V, and accordingly, the drum current Id becomes about 210 μA in this case of FIG. 10.

Figure 11:
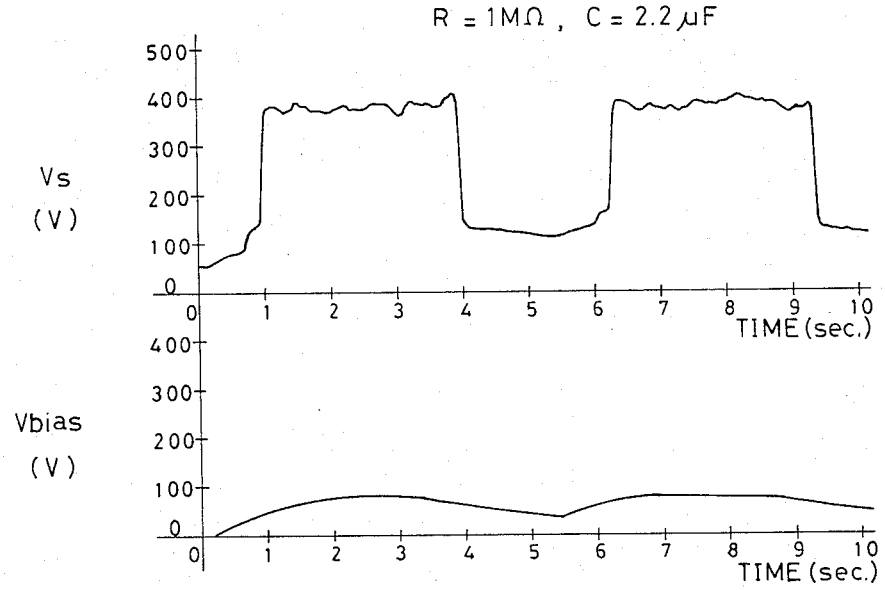
Figure 12:
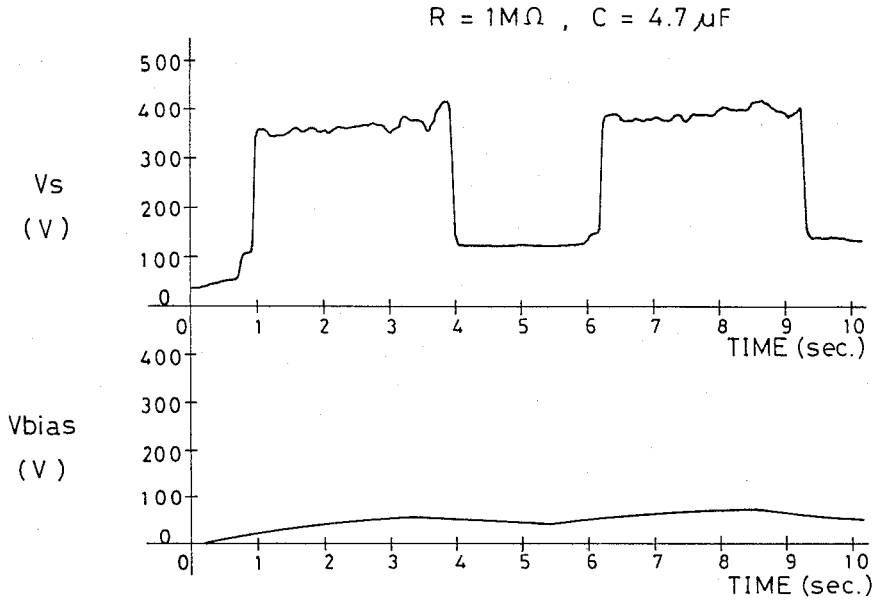

Furthermore, FIG. 11 is a waveform graph in the case where the resistor 461 of 1 MΩ and the capacitor 462 of 2.2 μF are used as the resistance circuit 46, and FIG. 12 is a waveform graph in the case where the value of the capacitor 462 is 4.7 μF. In either case, the bias voltage Vbias is greatly affected by the reactance of the capacitor 46 to become small, and responsively, the drum current Id becomes large. In the case of FIG. 11, the drum current Id becomes about 210 μA and in the case of FIG. 12, it becomes about 218 μA.

Figure 13:
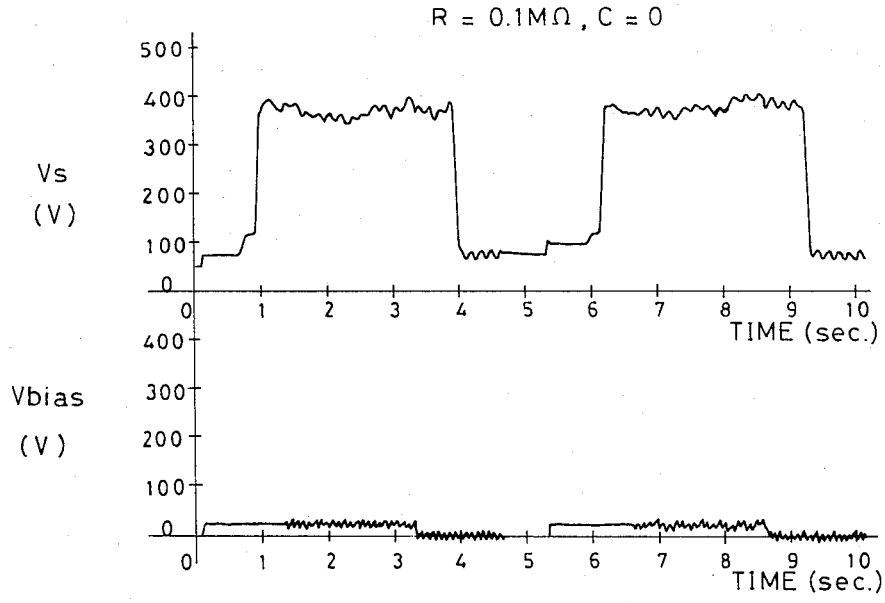

FIG. 13 shows waveforms of the bias voltage and the surface potential in the case where only the resistor 461 of 0.1 MΩ is used as the resistance circuit 46. In this case of FIG. 13, since the resistance in the resistance circuit 46 is very small, the bias voltage is small, too, but the drum current Id can be reduced to a smaller value of about 230 μA in comparison with the conventional example as shown in FIG. 6.

In an example in FIG. 13, since the resistance circuit 46 includes only the resistor 461, the effect of AC component is given like the previous case of FIG. 7. Accordingly, in order to eliminated such an effect of AC component, the capacitor 462 has only to be used.

Figure 14:
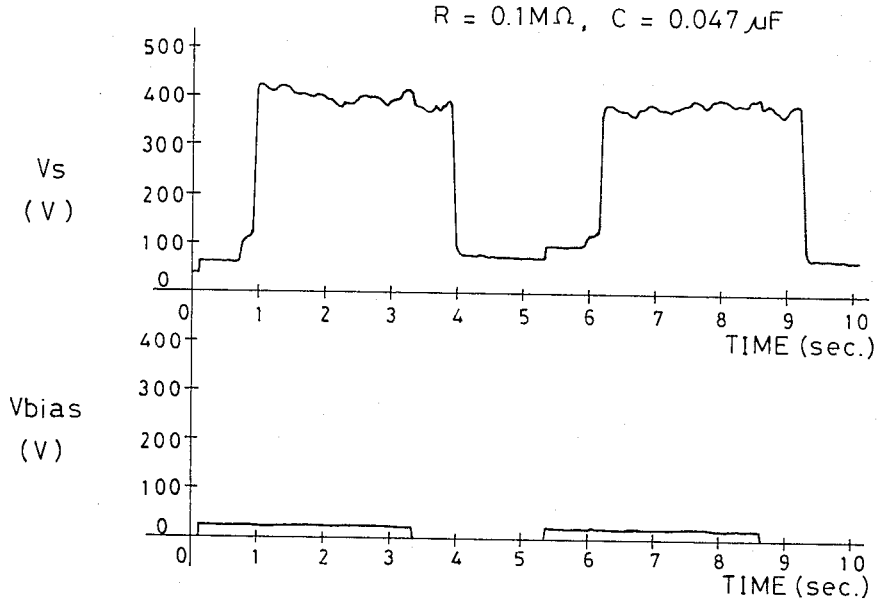

FIG. 14 shows a waveform graph in the case where the resistor 461 of 0.1 MΩ and the capacitor 462 of 0.047 μF are used as the resistance circuit 46. In this FIG. 14, the AC component scarcely appears.

Figure 15:
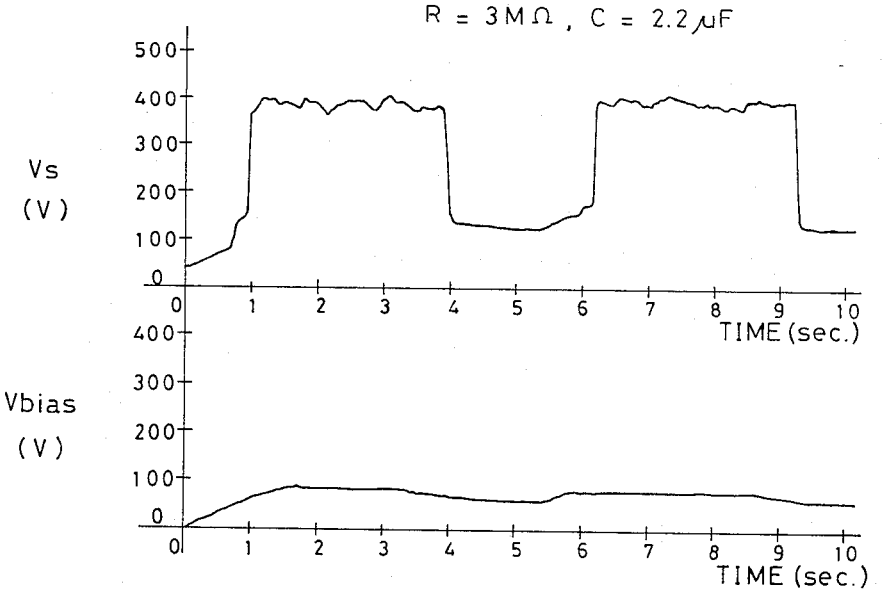

FIG. 15 is a waveform graph in the case where the resistor 461 of 3 MΩ and the capacitor 462 of 2.2 μF are used as the resistance circuit 46. In this case, the bias voltage became about 100 V, and the drum current Id was about 215 μA.

The following table shows the results of this series of experiments.

TABLE

| Sample Nos. | R (MΩ) | C (μF) | Id (μA) | Vbias (V) | Vs (V) |
|---|---|---|---|---|---|
| 1 (FIG. 6) | 0 | 0 | 235 | 0 | 400 |
| 2 (FIG. 7) | 1 | 0 | 173 | 173 | 400 |
| 3 (FIG. 8) | 1 | 0.047 | 173 | 173 | 400 |
| 4 (FIG. 9) | 1 | 0.5 | 175 | 160 | 400 |
| 5 (FIG. 10) | 1 | 1 | 210 | 75 | 400 |
| 6 (FIG. 11) | 1 | 2.2 | 210 | 75 | 400 |
| 7 (FIG. 12) | 1 | 4.7 | 218 | 75 | 400 |
| 8 (FIG. 13) | 0.1 | 0 | 230 | 23 | 400 |
| 9 | 0.1 | 0.01 | 230 | 23 | 400 |
| 10 (FIG. 14) | 0.1 | 0.047 | 230 | 23 | 400 |
| 11 | 3 | 0 | 100 | 300 | 400 |
| 12 | 3 | 0.5 | 160 | 200 | 400 |
| 13 (FIG. 15) | 3 | 2.2 | 215 | 75 | 400 |

Figure 16:
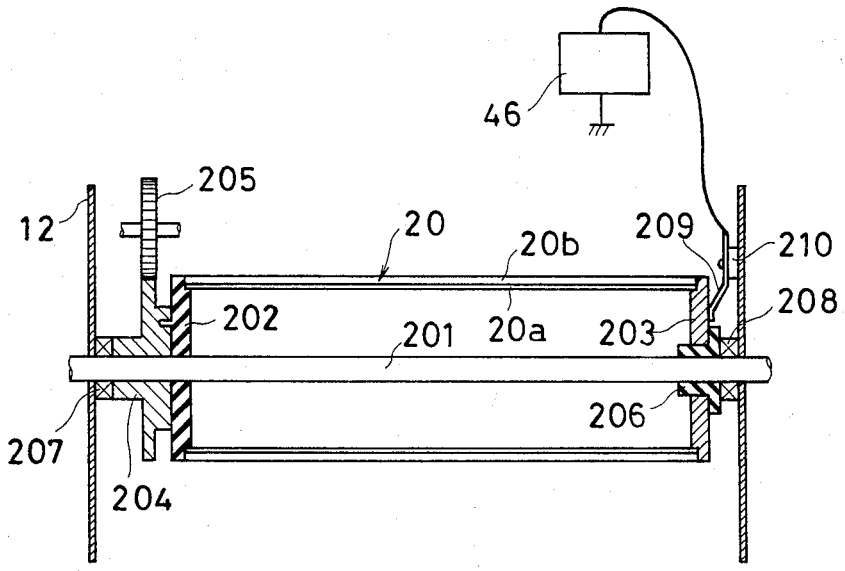

Here, description is made on one example of the concrete method of connecting the resistance circuit 46 between the photosensitive drum 20 and the reference potential in reference to FIG. 16.

The photosensitive drum 20 is supported rotatably on the body 12 by a shaft 201. A flange 202 composed of, for example, an insulating material such as synthetic resin is attached to one end of the photosensitive drum 20, and a flange 203 composed of a conductive material similar to the substrate 20*a* is attached to the other end. The flange 202 is made into one piece with a gear 204 composed of a conductive material such as metal. A gear 205 coupled to a driving source (not illustrated) is engaged with the peripheral side face of this gear 204. The conductive flange 203 is made into one piece with an insulating sleeve 206, and this sleeve 206 is fixed to the shaft 201. In addition bearings 207 and 208 are inserted between the shaft 201 and the body 12, respectively.

When the gear 205 is rotated by a driving source (not illustrated), the gear 204 engaging with it is rotated, and accordingly, the photosensitive drum 20 is rotated clockwise with the shaft 201 centered as is explained previously.

The tip of a conductive brush 209 attached to a supporting bed 210 is brought in contact with the end face of the conductive flange 203 at the other end of the photosensitive drum 20. Then, one end of this conductive brush 209 is grounded through the resistance circuit 46.

Furthermore, this resistance circuit 46 has only to be formed on a printed circuit board (not illustrated) which is accommodated in the control box 42 (FIG. 1).

Although other methods of connecting the resistance circuit 46 could be easily inferred by those skilled in the art, in brief, the conductive substrate 20*a* is floated from the ground potential, and then the resistance circuit 46 has only to be connected between the substrate 20*a* and the earth potential.

Although the present invention has been described and illustrated in detail, it is clearly understood that the same is by way of illustration and example only and is not to be taken by way of limitation, the spirit and scope of the present invention being limited only by the terms of the appended claims.

I claim:

1. An electrostatic recording apparatus, comprising:

a photosensitive body having a photoconductive layer;

a charging means for accumulating charges of a certain polarity on said photoconductive layer of said photosensitive body; and a resistance means for connecting said photoconductive layer of said photosensitive body to a reference potential, whereby a surface potential of said photoconductive layer is maintained by a voltage resulting from said charges and a voltage developed across said resistance means at a time when a current flows through said resistance means.

2. An electrostatic recording apparatus in accordance with claim 1, wherein:

said photosensitive body comprises a conductive substrate whereon said photoconductive layer is formed; and said resistance means is connected between said conductive substrate and said reference potential.

3. An electrostatic recording apparatus as in either claim 1 or claim 2, wherein said photoconductive layer is composed of amorphous silicon, and the resistance value of said resistance means is selected to 0.1–10 MΩ.

4. An electrostatic recording apparatus as in either claim 1 or claim 2, further comprising:

a reactance means which is connected to said resistance means, for forming a time-constant circuit in cooperation with said resistance means.

5. An electrostatic recording apparatus in accordance with claim 4, wherein said reactance means comprises a capacitance means connected on parallel with said resistance means.

6. An electrostatic recording apparatus in accordance with claim 5, wherein said photoconductive layer is composed of amorphous silicon, and the resistance value of said resistance means is selected to 0.1–10 MΩ and the capacitance value of said capacitance means is selected to 0.01–10 μF, respectively.

7. An electrostatic recording apparatus in accordance with claim 1, further comprising:

an exposing means for exposing said photosensitive body to form an electrostatic latent image;

a developing means for converting said electrostatic latent image into a toner image;

a transferring means for transferring said toner image onto a paper;

a separating means which produces an AC discharging for separating said paper whereon said toner image has been transferred from said photosensitive body; and a preventing means which is connected to said resistance means and prevents a surface potential of said photoconductive layer by said charging means from being affected by the AC component of said separating means.

8. An electrostatic recording apparatus in accordance with claim 7, wherein said preventing means includes a capacitance means connected in parallel with said resistance means.

* * * * *